United States Patent [19]

Saito et al.

[11] 4,029,071

[45] June 14, 1977

[54] FUEL INJECTION PUMP FOR DIESEL ENGINES

[75] Inventors: Atsushi Saito, Nagahama; Minoru Shimada, Kohoku, both of Japan

[73] Assignee: Yanmar Diesel Engine Co., Ltd., Osaka, Japan

[22] Filed: June 18, 1975

[21] Appl. No.: 587,859

[30] Foreign Application Priority Data

Apr. 14, 1975 Japan ..... 50-44994

[52] U.S. Cl. ..... 123/139 AS; 123/139 AB; 123/139 AK

[51] Int. Cl.[2] ..... F02M 39/00

[58] Field of Search ..... 123/139 AF, 139 AS, 123/32 F, 32 G, 139 AB, 139 AT, 139 AK, 139 BF, 140 A, 139 DE, 139 ST, 139 AY; 417/540

[56] References Cited

UNITED STATES PATENTS

| | | | |
|---|---|---|---|
| 1,974,851 | 9/1934 | Hurst | 123/139 BF |
| 2,559,364 | 7/1951 | Mashinter | 123/139 AK |
| 3,547,092 | 12/1970 | Knight | 123/139 AS |
| 3,752,136 | 8/1973 | Knight et al. | 123/139 AT |

*Primary Examiner*—Carroll B. Dority, Jr.
*Assistant Examiner*—David D. Reynolds
*Attorney, Agent, or Firm*—Armstrong, Nikaido & Marmelstein

[57] ABSTRACT

A fuel injection pump for Diesel engines comprises a plunger unit in the pump body, a delivery valve, and an injection-quantity control mechanism in the pump body between the plunger unit and delivery valve. The control mechanism has a piston slidable in the pump body and communicated with the plunger unit and delivery valve and also has an injection-quantity control member coaxial with the piston and axially adjustable in position to press the piston against the pump body with the aid of a spring on the other end of the piston. The lift limit distance of the piston to be adjusted by the injection-quantity control member is preset to a range not less than that obtained by dividing the quantity of fuel to be injected at the engine start by the cross sectional area of the piston.

2 Claims, 18 Drawing Figures a
b
c
-5
0
5
10
15
ANGLE OF ROTATION OF FUEL CAMS (DEGREES)
LIFTS OF NOZZLE VALVES (mm)

a
b
c
-5
0
5
10
15
ANGLE OF ROTATION OF FUEL CAMS (DEGREES)
RATE OF FUEL INJECTION (mm3/sec)

FUEL INJECTION PUMP FOR DIESEL ENGINES

This invention relates to a fuel injection pump for Diesel engines capable of controlling the beginning and rate of fuel injection in response to variations in engine load and speed, thereby to abate the noise due to irregular combustion and reduce pollutants in the exhaust gases during part load operation as well as in idling.

It is known that, with a typical fuel injection system, such steps as retarding the beginning of fuel injection, decreasing the injection rate, and moderating the change in the rate are all effective in lowering the combustion noise at part load and decreasing noxious exhaust emissions, particularly the oxides of nitrogen (NOx), under varied load conditions.

However, retarded beginning of fuel injection during part load operation is accompanied by a corresponding delay in the beginning of fuel injection at the rated engine speed at maximum load, resulting in a drop of maximum power output or in an increased fuel consumption. In order to overcome the difficulties, the fuel injection system has had to be provided with injection timing means for adjusting the beginning of fuel injection to suit the engine speed alone or both the engine speed and load. It is also known that the injection timing adds to the complicacy in construction and to the cost of the entire system.

In view of the foregoing, the present invention is directed to a fuel injection pump wherein a piston for storing excess fuel during delivery under pressure is installed (in a space to be hereinafter called a plunger chamber) between a delivery valve and plunger, and only the working stroke of the piston is adjusted to change the rate of fuel injection, so that the beginning and rate of fuel injection are varied according to the engine speed and load and thereby the abatement of combustion noise during part load operation and the reduction of harmful exhaust emissions (NOx is particular) can be accomplished.

The above and other objects, advantages, and features of the invention will become more apparent from the following detailed description taken in conjunction with the accompanying drawings, in which.

Figure 1:
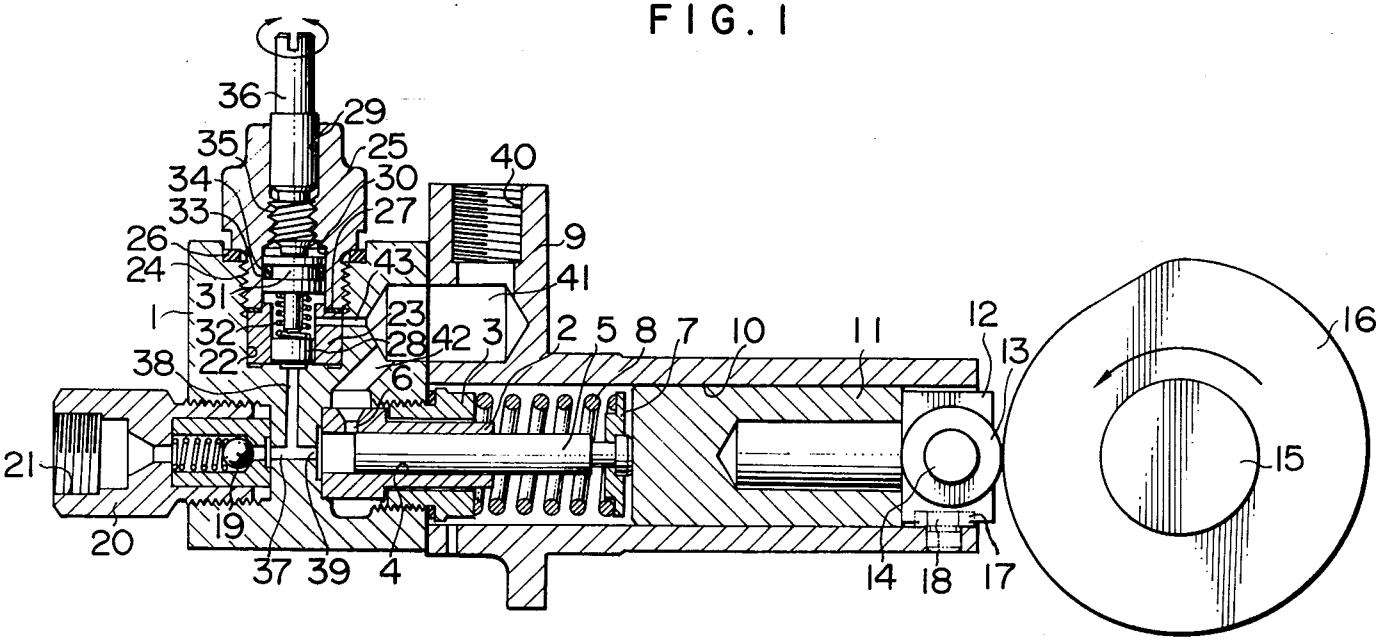
FIG. 1 is a longitudinal sectional view of an embodiment of the invention.

Referring to FIG. 1, the pump body 1 houses a plunger barrel 2 secured in the bore by a barrel support 3. In the bore 4 of plunger barrel 2, a plunger 5 is slidably and fitly received. A fuel inlet port 6 is formed in plunger barrel 2. The outer end of plunger 5 carries a plunger spring shoe 7. Between the barrel support and plunger spring shoe is coiled a plunger spring 8 round the plunger. The elements so far described are accommodated in a cylindrical bore 10 of a pump holder 9 fast on the pump body 1, the bore being concentric with the plunger. The outer end of the plunger is pressed against the inner end of a roller guide 11, which is slidably held in cylindrical bore 10. The outer end of roller guide 11 is cut out in the center to provide a pair of lugs 12, between which a roller 13 is rotatably supported by a pin 14, which extends at right angles to the axis of the roller guide. Roller 13 partly protrudes from the outer end of pump holder 9 and is biased by plunger spring 8 in pressure contact with a fuel cam 16 fixedly mounted on a camshaft 15, so that the rotation of fuel cam 16 in the direction of an arrow causes plunger 5 to reciprocate within plunger barrel 2. Lugs 12 of the roller guide are formed with an axial groove 17, in which the inner end of a stop 18 fast on pump holder 9 fits slidably to check rotation of the roller guide and permit its axial movement within a limited range. The afore-said components constitute a plunger unit according to the invention.

On the side of the pump body opposite to the plunger barrel, there is secured a fuel delivery valve 19 with a valve guard 20 aligned to the plunger. The outer end of the valve guard has a bore internally threaded as at 21 for connection with an injection pipe leading to an injection nozzle (to be described later in connection with FIG. 2).

Next, a mechanism for controlling the quantity of fuel injection in accordance with this invention will be described. In the upper portion of the pump body between the plunger barrel and delivery valve, there is formed another bore 22 for receiving a regulator at a right angle to the axis of the plunger, and a cylindrical piston guide 23 is fitted in the bore. A regulator body 25, which has an externally threaded part to mesh with an internally threaded part 24 of the regulator-receiving bore, is screwed into the pump body with a packing 26 in between. In this way the piston guide is pressed against, and securely held by, the pump body portion constituting the bottom of the regulator-receiving bore, through a seal 27 disposed on a shoulder of the piston guide. A piston 28 is placed in the bore of the piston guide and is slidable along the inner surface thereof, the dismetric clearance between the piston and the surrounding wall of piston guide being within the range of $1 - 9. \mu (10^{-6}m)$ in order to minimize leakage and insure uninterrupted motion of the piston. Between the piston 28 and a regulator piece 31 slidably inserted in a large-diameter section 30 of the bore 29 of regulator body 25 is extended a piston spring 32. An O ring 34 is fitted in an annular groove 33 on the regulator piece to provide liquidtightness. Bore 29 has a right-hand threaded section 35 of a relatively large pitch for the feeding purpose, which is meshed with a correspondingly threaded portion of a regulator spindle 36. By the force of piston spring 32 the regulator piece 31 is biased upward so that its top is in contact with the lower end of the regulator spindle. Thus, when regulator spindle 36 is turned through a pump control lever (to be described later with reference to FIG. 2) on the top of the spindle, the distance between the lower protruding end of the regulator piece and the piston, or the lift of the piston, will be adjusted. While the axial position of the regulator spindle, or injection-quantity control member, in the embodiment being described is adjusted by use of thread engagement, other means, e.g., cam action, may be utilized instead.

The operative relations among the fuel injection-quantity control mechanism, plunger unit, and delivery valve will now be explained. For communication between the inner end of the bore 4 of the cylinder barrel and delivery valve 19, the pump body is formed with a passage 37, which is branched midway by another passage 38 extending upward and communicating with the underside of piston 28. The space between the front end of the plunger and the delivery valve 19, including these passages, constitutes the above-mentioned plunger chamber 39.

Pump holder 9 has an internally threaded bore 40 for connection with fuel oil line, so that fuel from the line is once led into a fuel supply chamber 41 and is thence supplied through a passage 42 to the fuel inlet port 6 of the plunger barrel. For the oil leaking from around the piston, a relief passage 43 is formed across the piston guide and pump body and is communicated with fuel supply chamber 40.

The operation of the injection pump in conformity with the present invention will now be described in conjunction with FIG. 2, which illustrates a fuel injection-quantity control mechanism of a Deckel fuel injection system for a small-size engine incorporating the principles of the invention. A regulator handle base 44 fixed to a suitable part of the engine has marks indicating the directions in which the engine operation is stopped or accelerated, the load conditions such as for starting, and graduations for speed control. If the operator grips a regulator handle knob 46 fixed to a regulator handle 45 and moves and sets the knob to a starting position on the left part of the regulator handle base, a regulator spring 47 operatively connected at one end to the regulator handle will then be pulled. Here it is noted that the other end of the regulator spring is fixed to the end of one arm 51 of a second governor lever 50 supported by a pivot 49 which extends rotatably through the wall of a governor-gear housing 48 in such a manner that the lever is turnable with the pivot 49, while the end of the other arm 52 has a downward protrusion which slidably fits in a slot 54 formed in a pump control lever 54 mounted on regulator spindle 36 for turning therewith. Therefore, as the regulator spring is pulled, the second governor lever turns counter-clockwise about pivot 49, enabling the pump control lever to rotate regulator spindle 36 clockwise. Consequently, the regulator spindle, in thread engagement with the right-hand threaded feeding section 35 of the regulator body, moves downward as viewed in FIG. 1, forcing the piston downward through regulator piece 31 against the pump body wall. In the embodiment shown in FIG. 2, fuel from a tank of the gravity feed type (not shown) flows through a fuel filter 55 at the outlet to an oil-gauge fuel cock assembly 56. It then passes through a fuel oil line 57 into fuel supply chamber 41 in the pump body (FIG. 1). Further, it flows through passage 42 and fuel inlet port 6 into plunger chamber 39. Under increasing pressure by the plunger on its discharge stroke, the fuel which is unable to urge the piston upward is totally forced out of a fuel injection valve 59 via the delivery valve 19 and injection pipe 58. Any abnormal increase of the engine speed at the start will lift the governor spindle 61 of a governor assembly 60 toward the front as viewed in FIG. 2. Accordingly a first governor lever 62 is turned clockwise because it is secured to the inner end of a pivot 49 and has an enlarged free end 63 kept, via a ball (not shown) partly exposed outwardly and held turnably therein, in contact with the top of the governor spindle by regulator spring 47 so pulled as to act on the second governor lever 50 on the same pivot. As a result, via the arm 52 of the second governor lever and pump control lever 53, the regulator spindle 36 is turned counter-clockwise, or upward as seen in FIG. 1. Corresponding to this rotation, there is formed an axial space (to be hereinafter referred to as a lift limit distance) in which the piston when subjected to a fuel pressure on its lower end will move upward until it hits against the lower protruding end of the regulator piece. Then, for the reasons to be explained later, the quantity of fuel injection is decreased and the engine is controlled to run at the normal starting speed.

A crankshaft gear 64 in governor-gear housing 48, meshed with a camshaft gear 65 on camshaft 15, drives fuel cam 16 held on the camshaft and in contact with roller 13.

The operation of the pump according to the invention will more fully be described hereunder in connection with FIGS. 3A through 3F, which illustrate the pump in different stages of operation as tabulated below.

Figure 3A:
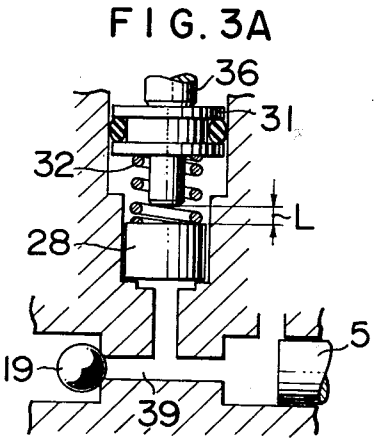
FIGS. 3A through 3F are sequential views showing the embodiment of FIG. 1 in operation.
Figure 3C:
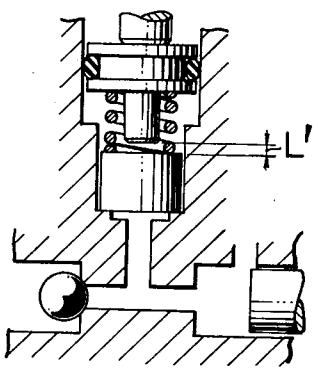
Figure 3E:
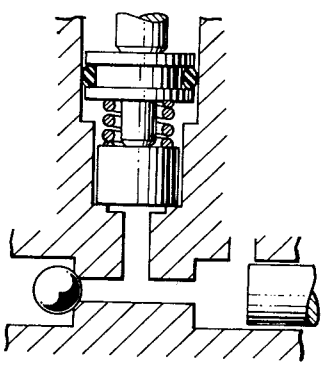
Figure 3B:
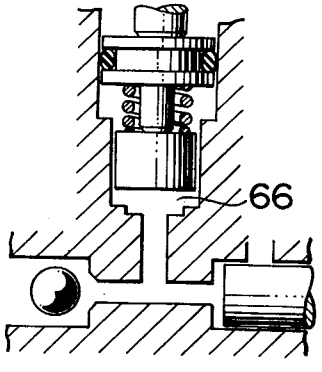
Figure 3D:
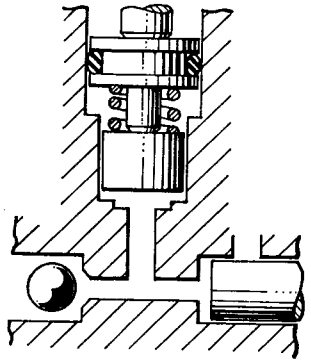
Figure 3F:
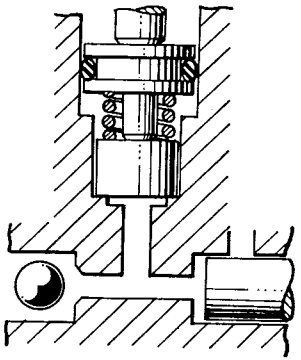

| Plunger position | No injection | Under load | At engine start |
|---|---|---|---|
| At the start of delivery | FIG. 3A | FIG. 3C | FIG. 3E |
| At the end of delivery | FIG. 3B | FIG. 3D | FIG. 3F |

Figure 2:
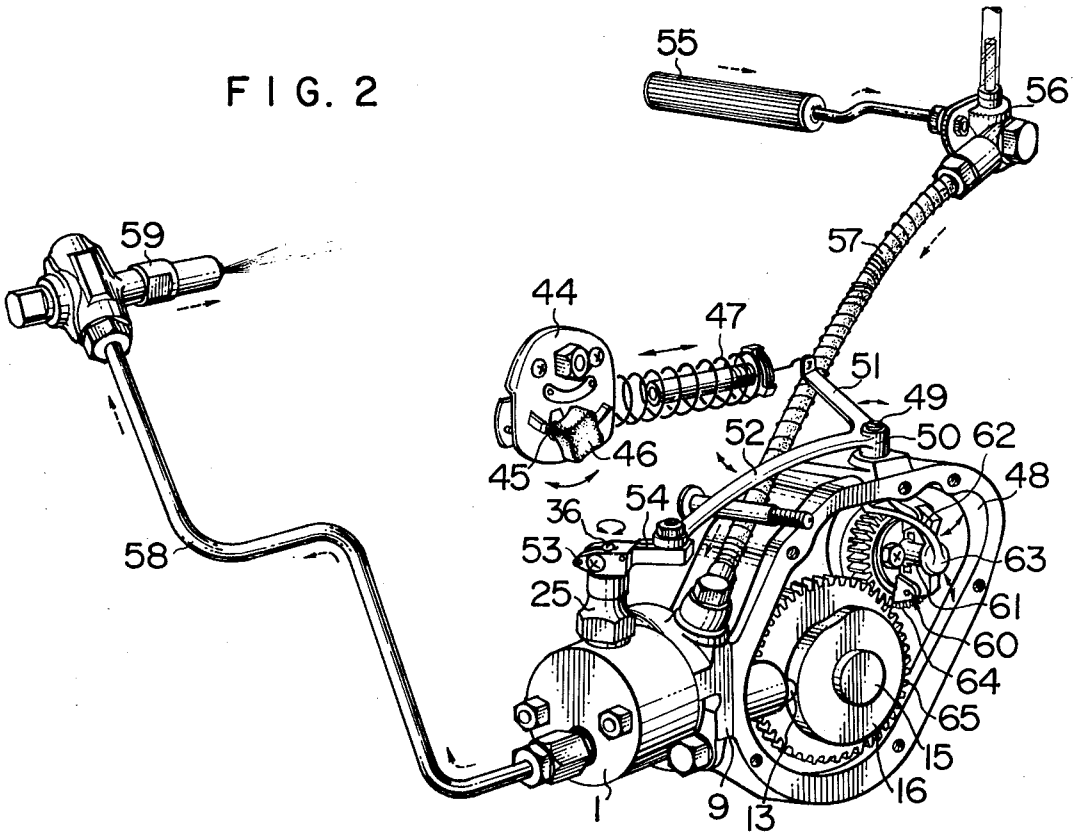
FIG. 2 is a schematic view of an injection-quantity control mechanism of a Deckel fuel injection system incorporating the principles of the invention.

First, it is assumed that the regulator handle know shown in FIG. 2 is set to the stop position on the right part of the regulator handle base in order to reduce the amount of fuel injected to zero and thereby stop the engine. In FIG. 2 the regulator spring 47 that is compressed will turn the second governor lever 50 clockwise and regulator spindle 36 fully counter-clockwise. Thus, when the plunger begins its delivery motion, the components are in such relative positions as shown in FIG. 3A. Piston 28 is forced against the pump body by virtue of piston spring 32 and the lift limit distance L is at a maximum. When the plunger has advanced to the point where it completes its discharge stroke, the amount of fuel being forced out by the plunger as in FIG. 3B is the sum of the quantity being discharged by the delivery valve, the quantity being lifted by the piston, and that flowing out along the sliding periphery of the piston. However, because of the great lift of the piston, the pressure in plunger chamber 39 is low and the fuel is kept from issuing out from the nozzle. The lift limit distance L in the no-injection period is, of course, set to a value such that the capacity of piston chamber 66 when the piston is in its up position will exceed the volume of fuel to be delivered by a single stroke of the plunger. Also, the piston spring setting keeps the pressure in the plunger chamber, with the piston lifted to the limit, well below the injection starting pressure at the nozzle. As fuel cam 16 further rotates and the plunger draws back, the pressure in the plunger chamber diminishes, with the result that the delivery valve closes and the piston is urged downward against the pump body by the force of the piston spring. In this manner the original state of FIG. 3A is resumed.

When the engine is running under load, the pump according to the invention operates as follows. As shown in FIG. 2, the regulator handle knob is moved in the direction of acceleration indicated on the regulator handle base and is set to a desired engine speed and load. Thus, if the plunger is at the beginning of delivery, the lift limit distance L′ of the piston will be less than that during the injection-free period, as will be obvious from FIG. 3C. Advance of the plunger first closes the fuel inlet port of the plunger barrel, forcing fuel out rapidly. Next, the piston is pushed up to the regulator piece, while the delivery valve is opened. The oil pressure in the line between the plunger and nozzle is further increased abruptly and the fuel is shot out of the nozzle. Finally the plunger arrives at the point where the discharge stroke is concluded. The plunger and related parts in the pump then assume the relative positions as illustrated in FIG. 3D. In this case the amount of fuel injection is approximately equal to that of fuel discharged by the plunger minus the quantity by which the piston is raised to the upper extremity of the lift limit distance. At last, the operation of the pump at the engine start will be explained. Here, as already stated, the piston is kept in pressure contact with the pump body by the regulator piece throughout the discharge stroke of the plunger as shown in FIGS. 3E and 3F; hence the lift limit distance is zero. Consequently, almost all fuel discharged by the plunger is shot out of the nozzle.

As has been described, the present invention provides a construction in which a piston is installed between a plunger unit and a delivery valve and the lift limit distance of the piston is made variable to control the amount of fuel to be injected.

Experimentally the injection characteristic of the pump embodying the invention (shown in FIG. 1) was compared with those of conventional pumps (in FIGS. 4 and 5), wherein like numerals designate like or corresponding parts. The results will be discussed hereunder.

Figure 4:
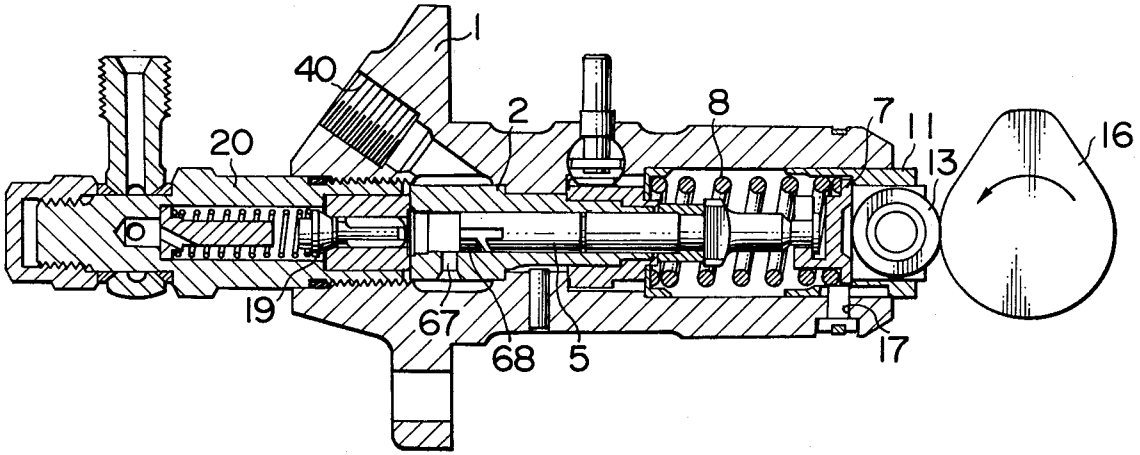
FIG. 4 PRIOR ART
FIG. 4 is a longitudinal sectional view of a conventional Bosch pump.
Figure 5:
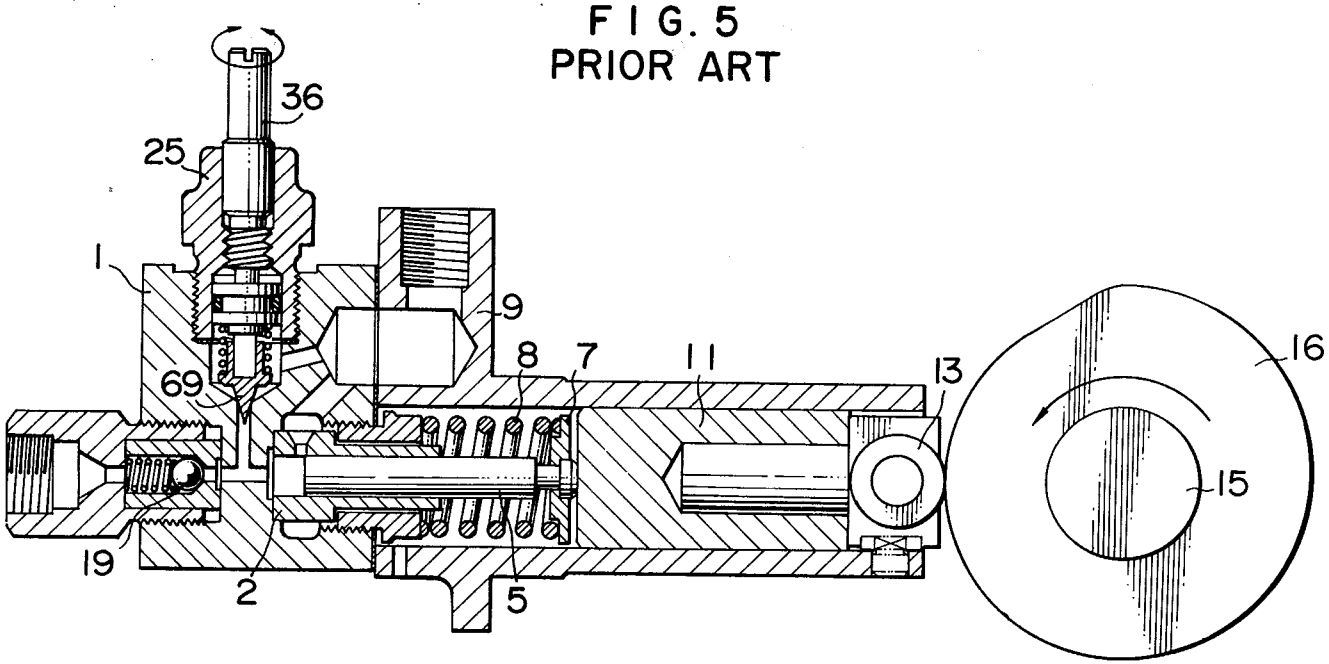
FIG. 5 PRIOR ART
FIG. 5 is a longitudinal sectional view of a conventional Deckel pump.

The test pumps selected had plungers of the same size and their effective injection ranges were substantially the same. First, the injection-quantity control mechanisms of the conventional pumps will be considered. In FIG. 4, which shows a Bosch injection pump, numeral 67 is a fuel port formed in the plunger barrel. In this case a single port is used to permit suction and discharge of fuel therethrough. 68 is the helix distance at the head of the plunger, or the stroke length. The top surface of the plunger shown is flat. The quantity of fuel injection is controlled by turning the plunger and varying the duration of the period in which the stroke length 68 of the plunger on its forward stroke covers the fuel port 67 of the plunger barrel. Naturally the fuel pressure in the injection system begins to increase abruptly from the moment the stroke length closes the fuel port, and the uncovering of the port permits the fuel to flow out of the plunger chamber through the fuel port, causing a sharp drop of the fuel pressure. Thus, the variation of fuel pressure in the injection system usually is steep and drastic. FIG. 5 shows a Deckel pump, in which 69 is a regulator needle. The amount of fuel delivery is controlled by turning the regulator spindle 36 and changing the lift limit distance of the regulator needle and thereby changing the opening area of the regulator needle valve seat while the plunger on its delivery stroke is forcing fuel out. As soon as the head of the plunger covers the fuel port the pressure in the injection system begins to increase sharply, and the plunger continues to deliver fuel unit it reaches the point of maximum lift, while, at the same time, fuel flows out from between the needle valve and the valve seat. Consequently, the fuel pressure variation in the system generally is moderate and limited. The injection characteristics of the three pumps were comparatively studied and the following results were obtained.

FIGS. 6A to 6D are graphs comparing the variations in the lift of nozzle valves relative to the angles of rotation of fuel cams to the different pumps. The graphs summarize the results given under the operating conditions tabulated below.

Figures 6A, 6B, 6C, 6D:
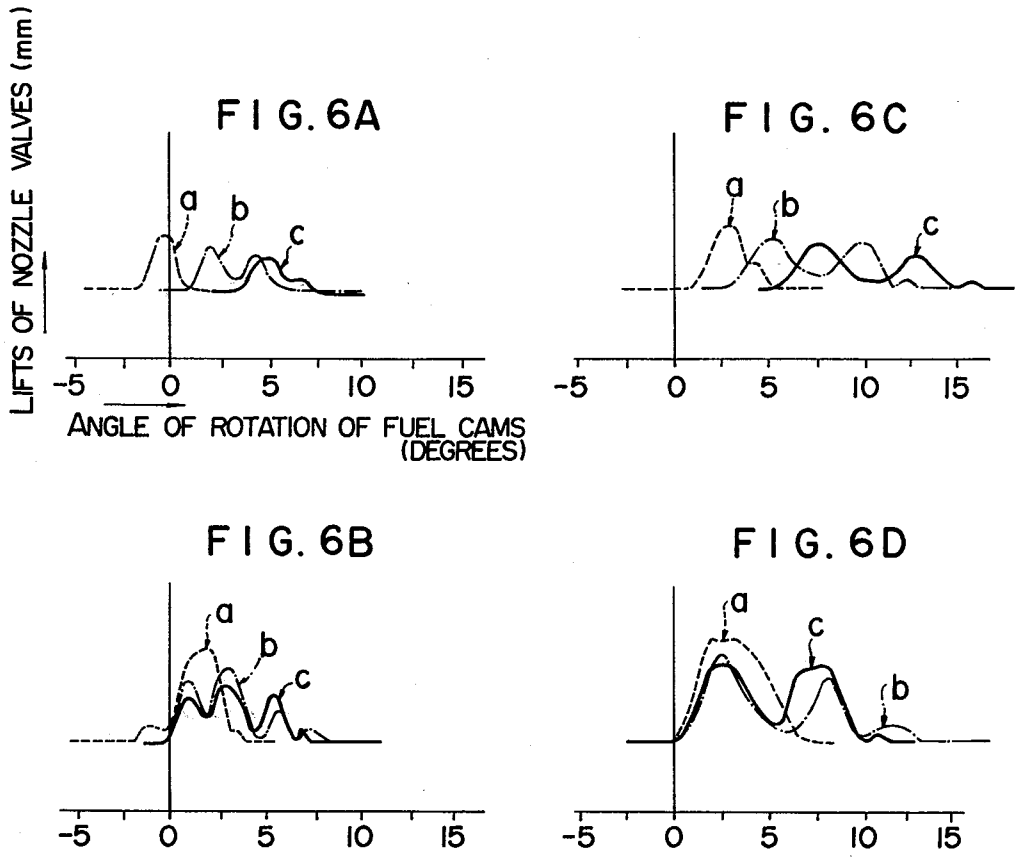
FIGS. 6A and 6D are graphs comparing the lift of nozzle valve used in the pump of the invention of FIG. 1 with the lifts in the conventional pumps of FIGS. 4 and 5, as measured during fuel injection.

| Injection quantity ($mm^3$/stroke) | Fuel cam speed (rpm) Low | High |
|---|---|---|
| Small | FIG. 6A | FIG. 6C |
| Large | FIG. 6B | FIG. 6D |

In the graphs, the broken-line curve *a* represents the injection characteristic of the Bosch pump, the alternate-dash-and-dot-line curve *b* that of the Deckel pump, and the full-line curve *c* that of the pump according to the invention.

The test conditions chosen were as follows. The expression "small-injection low-speed" operation (FIG. 6A) as used herein means that the engine ran in the conditions near idling. The "large-injection high-speed" operation (FIG. 6D) means rated operating conditions, and in this state the lift limit distances of the Deckel pump and the pump of the invention were not zero. The three pumps were equally timed for the beginning of injection in the large-injection high-speed operation. When the operation was shifted from FIG. 6B to FIG. 6A or from FIG. 6D to FIG. 6C, that is, when the amount of fuel injected, in cubic millimeters per plunger stroke, was decreased while the fuel cam was allowed to rotate at a constant speed, a delay in the beginning of injection as represented by the angle of rotation of the fuel cam resulted in all the pumps tested. The delay was the least in the Bosch pump and the greatest in the pump of the invention. Conversely when the operation was switched from FIG. 6C to FIG. 6A or from FIG. 6D to FIG. 6B, that is, when the fuel cam speed was decreased while maintaining a constant amount of fuel injection per stroke, all the pumps indicated advanced timing for the beginning of injection, the Bosck pump coming in the first followed by the Deckel pump and the pump of the invention in order of decreasing angle of advance. Finally, when the mode of the engine operation was changed from large-injection high-speed (FIG. 6D) to small-injection low-speed (FIG. 6A), the beginning of injection was advanced in the Bosch pump but was retarded in the Deckel pump and even more in the pump of the invention. This means that if the maximum injection timing of the Bosch pump is set under the rated (that is, large-injection high-speed) operating conditions, then the beginning of injection will be advanced when the engine idles (or runs with a small amount of fuel injection at low speed), tending to knock with irregular combustion. An attempt to deaden the noise by retarding the angular phase of the fuel cam for the beginning of injection (in the direction on the plus side in the graphs) is effective for that matter but with penalty in combustion performance and with a decline of maximum power output. If the noise during idling is to be prevented and also the combustion performance during rated operating conditions are to be improved, the addition of a special injection timing device will become necessary. On the other hand, with the pump of the invention, the beginning of injection during idling is retarded even if the beginning is optimumly timed under rated operating conditions, and hence there is no possibility of knocking. Thus, without the need of providing any special timing means, the engine can achieve adequate combustion performance under rated operating conditions. Since the comparative tests were conducted with the arrangements in which the pumps alone were different but the injection valves and other parts were the same, the variation in the lift of the nozzle valve in each arrangement had close correlation with the variation in the fuel oil pressure that actuated the nozzle valve. It is noted that, because of these variations, the Bosch pump shortens the injection period and involves sharp fuel pressure variation. With the Deckel pump the injection period is longer and the pressure variation is moderate. The pump according to the invention exhibits characteristics similar to those of the Deckel pump but the injection period is even slightly longer and the variation is more moderate.

FIGS. 7A to 7D are graphs comparing the fuel injection rates, or the amounts of fuel injected from nozzle orifices per momentary unit period, of the test pumps. The tests the results of which are plotted therein were carried out under the following conditions.

Figures 7A, 7B, 7C, 7D:
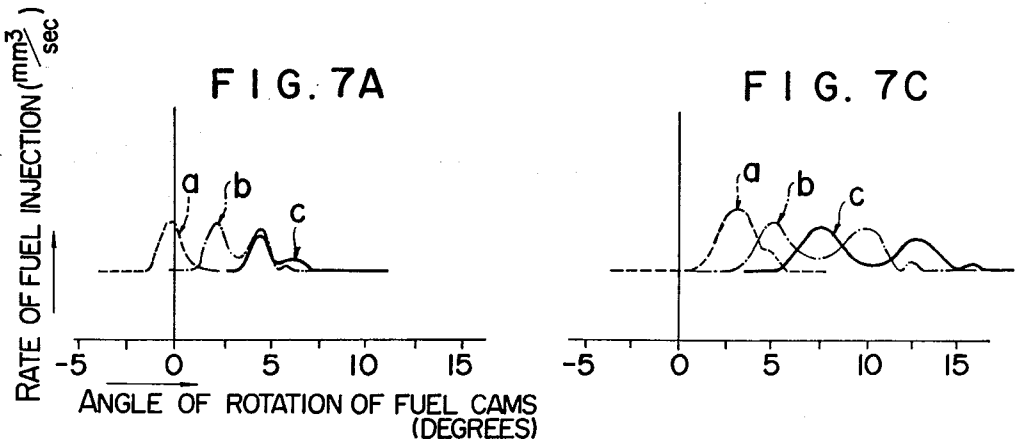
FIGS. 7A to 7D are graphs comparing the rates of fuel injection by the same pumps as in FIGS. 6A to 6D, as measured during fuel injection.

| Injection quantity ($mm^3$/stroke) | Fuel cam speed (rpm) Low | High |
|---|---|---|
| Small | FIG. 7A | FIG. 7C |
| Large | FIG. 7B | FIG. 7D |

In the graphs the borken-line curve *a* represents the results of test with the Bosch pump; the alternate-dash-and-dot-line curve *b* those with the Deckel pump; and the full-line curve *c* those with the pump of the invention.

With the pump of the invention the rate of fuel injection ($mm^3$/sec.) was the lowest and the variation was moderate. Repeated tests indicated highly stable reproducibility of the data.

It will be understood from the foregoing description that the fuel pump according to the invention satisfactorily meets the requirements, specifically the retardation of the beginning of injection at part load and the reduction and the moderation in variation of the injection rate, that are known to be effective in improving the fuel injection system, decreasing the combustion noise during part load operation and reducing the noxious exhaust emissions, particularly NOx, in variously loaded conditions, as mentioned in the early part hereof.

In addition, the pump of the invention is easy to machine because its plunger and piston have no metering helix and are simple in configurations. Hence the pump has a long service life.

As already noted, the Deckel pump shown in FIG. 5 is designed so that fuel is bypassed to the inlet port via the narrow gap between the regulator needle and the valve seat in the pump body, and therefore the amount of fuel to be bypassed directly depends on the lift of the regulator needle spring. Any minor permanent strain of the spring would impair the pump performance and vary the rate of injection unfavorably. The pump according to the invention is free from such a disadvantage because the fuel is not bypassed but the positive displacement of fuel is preset by the piston.

While a preferred embodiment has been described, it will be understood by those skilled in the art that the invention is not limited thereto but may be otherwise variously embodied without departing from the spirit and scope of the invention.

What is claimed is:

1. In a fuel injection pump for Diesel engines comprising plunger means installed in the pump body, a delivery valve, and injection-quantity control means provided in the pump body between the plunger means and delivery valve, said control means having a piston slidably disposed in the pump body, with the space adjacent to one end thereof communicated with the plunger means and delivery valve, the improvement wherein said injection-quantity control means further comprises a regulator spindle means for displacing said piston in direct response to the speed of rotation of the engine, said regulator spindle engaging a regulator piece disposed between said spindle and the other end of said piston in coaxial relationship therewith, said regulator piece being axially adjustable by said regulator spindle to press the piston against the pump body through the agency of a spring located on the other end of the piston, the maximum volume displaced by the piston being determined by the injection-quantity control means and being preset to a range not less than the volume injected initially at the engine start.

2. The fuel injection pump of claim 1 wherein said regulator spindle means is coupled with speed governor means connected with said engine for activating said spindle means in response to the speed of the engine.

* * * * *